United States Patent [19]

Wiese

[11] 4,043,250

[45] Aug. 23, 1977

[54] RECOILABLE GUN TUBE LATCH

[75] Inventor: Harold Herman Wiese, Davenport, Iowa

[73] Assignee: The United States of America as represented by the Secretary of the Army, Washington, D.C.

[21] Appl. No.: 700,643

[22] Filed: June 28, 1976

[51] Int. Cl.[2] ..... F41F 19/16

[52] U.S. Cl. ..... 89/170; 89/42 B; 89/198

[58] Field of Search ..... 42/69 A; 74/2, 520; 89/42 B, 170, 180, 198; 292/DIG. 49, 223

[56] References Cited

U.S. PATENT DOCUMENTS

| | | | |
|---|---|---|---|
| 2,249,231 | 7/1941 | Smith | 42/69 A |
| 2,249,232 | 7/1941 | Smith | 42/69 A |
| 2,303,027 | 11/1942 | Curtiss | 292/223 |
| 3,483,648 | 12/1969 | Speckhart | 89/42 B |

FOREIGN PATENT DOCUMENTS

| | | | |
|---|---|---|---|
| 57,563 | 11/1911 | Switzerland | 42/69 A |

*Primary Examiner*—Stephen C. Bentley

*Attorney, Agent, or Firm*—Nathan Edelberg; Harold H. Card, Jr.; Robert O. Richardson

[57] ABSTRACT

This invention relates to new and improved methods and modular apparatus for automatically latching, unlatching and resetting of the latch mechanism of gun tubes of weapon systems of the "soft recoil" type having recoil and counterrecoil functions or cycles by utilization of a plunger latch mechanism which is pivotally actuatable by toggle means to unlatch the gun tube and permit movement of the gun tube to its firing position in the direction of the muzzle of the gun. The toggle means resets the latch to its latch position automatically in response to the relative position of the gun tube during movement thereof to its firing position. The plunger, being moved from its latch position by the gun tube during recoil movement of the gun tube, returns automatically to its latch position in response to the relative position of the gun tube during recoil so that the plunger is again in its latch position when engaged by the gun tube during its counterrecoil movement.

3 Claims, 8 Drawing Figures

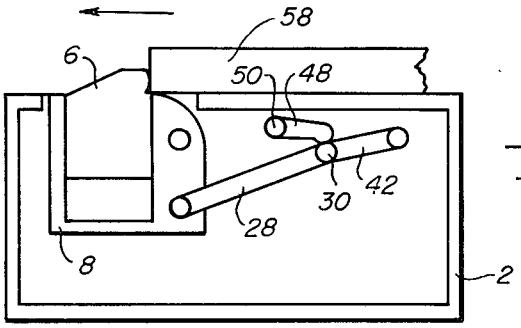
58
6
50
48
42
30
28
8
2
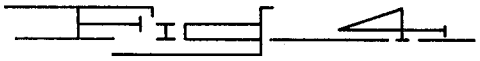
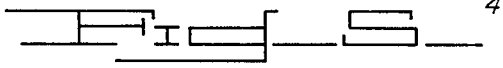
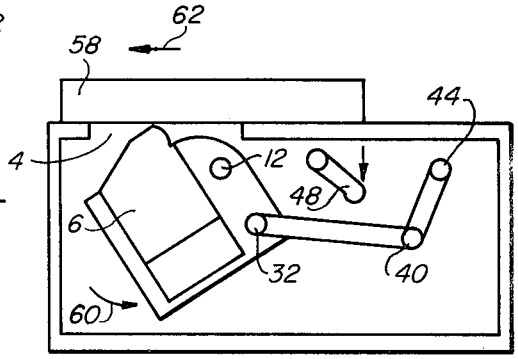
62
58
44
4
12
48
6
32
40
60
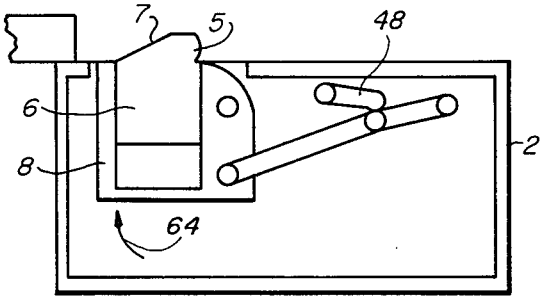
7
5
48
6
8
2
64
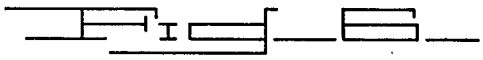
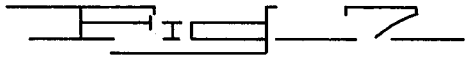
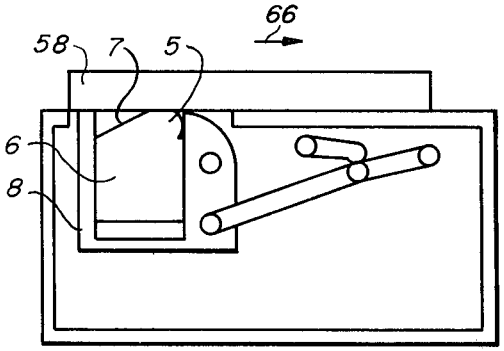
66
58
7
5
6
8
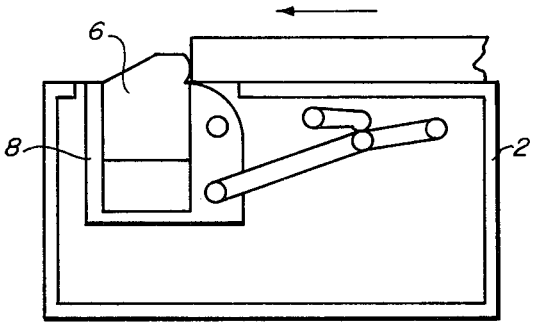
6
8
2
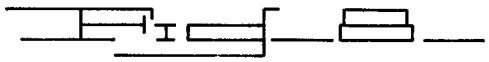

RECOILABLE GUN TUBE LATCH

GOVERNMENT RIGHTS

The invention described herein may be manufactured and/or used by or for the Government for governmental purposes without the payment of any royalty thereon.

BACKGROUND OF THE INVENTION

In large caliber guns of the "soft recoil" type, such as described in U.S. Pat. No. 3,604,308 and assigned to the same assignee, it is essential that the recoiling parts be latched in a stationary rearward position on the cradle to permit a new round of ammunition to be loaded into the firing chamber of the gun tube. The problems and difficulties encountered heretofore with prior art latch devices are set forth hereinafter and in said patent, the disclosure of which is hereby incorporated by reference.

SUMMARY OF THE INVENTION

The present invention overcomes these problems and difficulties of the prior art, among others, by the provision of an enclosed modular latching mechanism for the recoiling parts of the weapon system capable of holding the recoiling parts in a stationary rearward position on the cradle to permit reloading of the weapon upon termination of the recoil cycle of the gun tube. The latching mechanism of the present invention includes a housing toggle means in a housing latch, a plunger assembly carried by a pivotal plunger housing connected to said toggle means, means to actuate the toggle means to pivot the plunger housing in order to permit movement of the plunger latch out of the path of the moving parts as they move into firing position in the direction of the muzzle of the gun tube. Said latching mechanism also includes means to automatically and positively reset the toggle means, thereby to reset the plunger assembly in latch position after the moving parts disengage from contact with said latch plunger assembly as it moves to the firing position. The plunger being depressible by contact by the moving parts during recoil of the moving parts to move the plunger from its latch position and to permit continuation of movement of the recoiling parts. The depressed plunger is automatically returned to its latch position in response to the relative position of the moving parts during recoil movement thereof so that the gun tube is relatched by the plunger at the termination of counterrecoil movement of the gun tube.

BRIEF DESCRIPTION OF THE DRAWINGS

FIG. 4 is a diagramatic sketch of the plunger and plunger housing in their initial latch and load position, FIG. 5 is a diagramatic sketch of the plunger and its housing illustrating their position upon initiation of firing of the weapon system, FIG. 6 illustrates the positions of the plunger and its housing after having been automatically reset to their latch position, FIG. 7 illustrates the mode of operation during recoil whereby the recoiling parts depress the plunger from their path of movement, FIG. 8 illustrates the latch position of the plunger during counterrecoil movement of the moving parts.

DESCRIPTION OF THE PREFERRED EMBODIMENT

Figure 1:
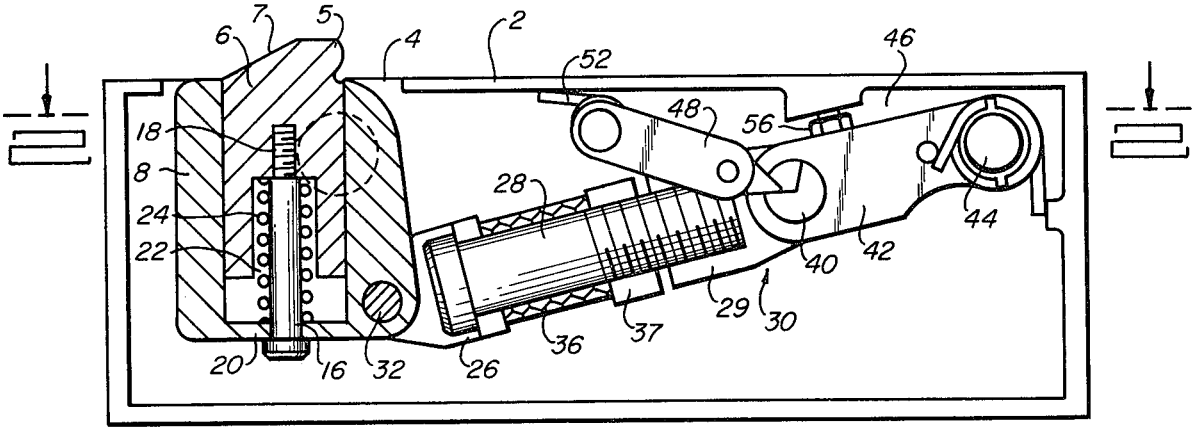
FIG. 1 is a left side view in section of a preferred embodiment of the present invention.
Figure 2:
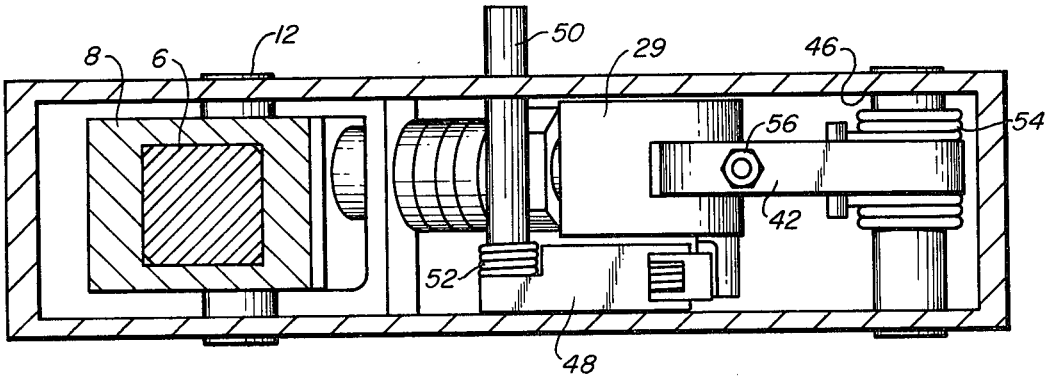
FIG. 2 is a view taken along line 2—2 of FIG. 1.
Figure 3:
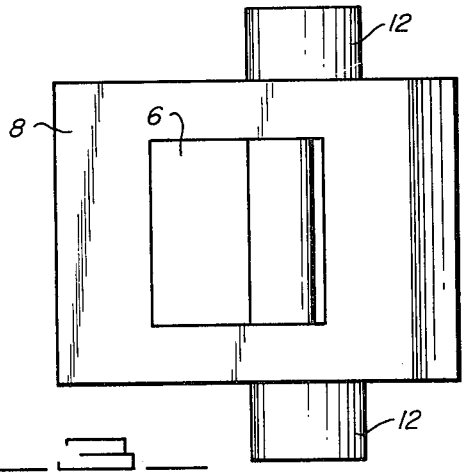
FIG. 3 is a plan view of the plunger housing of FIG. 1.

Referring to FIGS. 1, 2 and 3 there is illustrated a substantially rectangular housing 2 having an opening 4 thru which extends the head 5 of a plunger 6. The head 5 is sloped as at 7 for purposes hereinafter stated. The plunger 6 is capable of reciprocal motion in a plunger housing 8 which is pivotably carried by the housing 2 as by trunnions 12 (FIG. 3).

To permit depression and return of the plunger head 5 to its latch position shown in FIG. 1 a guide shaft 16 is connected to the plunger as at 18 and movably extends through a base 20 of housing 8 into a recess 22 formed in the plunger 6. Spring means 24 are located in the recess 22 and urge the plunger 6 to position the plunger head 5 in its latching position.

A bifurcated bracket 26 of a link 28 of an over center toggle assembly 30 is pivotably connected as at 32 near the base of the plunger housing 8. The link 28 carries a ring spring assembly 36 for absorption of impact when the counterrecoiling gun tube goes into latching position. An adjusting nut 37 is also carried by the link 28 to adjust tension on the ring spring means 36.

The opposite end of the toggle link 28 carries a bracket 29 which is pivotably connected as at 40 for over center movement to another link 42 of the toggle assembly. The opposite end of the link 42 is pivotably connected as at 44 to the interior of the wall 46 of housing 2.

A control link 48 completes the toggle assembly and is mounted at one end for pivotable movement by an actuator 50 operably connective to the weapon firing lanyard (not shown). A coil spring 52 circumscribes the actuator 50 and urges the control link 48 toward its reset position.

Spring 52 also cooperates with a reset spring means 54 acting on link 42 to automatically reset the toggle links in their operative latching position during the movement of the gun tube to its firing position. Stop means 56 may be utilized to prevent damage to the links.

The recoiling parts of the gun tube assembly are depicted schematically as a single modular mass in FIGS. 4–8.

Schematically FIGS. 4 through 8 illustrate the sequence of operation of the modular latch assembly of the present invention from where the firing command is given through the counterrecoil of the gun recoil mechanism.

Before initiation of the firing command the plunger 6 extends through the opening 4 in latching position to prevent movement of the recoiling mass 58. The plunger housing extends perpendicular to the horizontal axis of housing 2. The toggle assembly is in its normally latching position.

Upon the issuance of the firing command, the operator pulls the lanyard which in turn rotates shaft 50 which acting on link 48 causes collapse of the toggle assembly 30. Collapse of the toggle assembly permits pivoting of the plunger latch housing 8 in the direction as shown by the curved arrow 60 of FIG. 5. After lanyard is pulled, the recoil system gas pressure system (not shown) causes the recoil mass 58 to move forward in the direction of the straight arrow 62 in FIG. 5. The recoil mass, in moving forward, tilts about about the plunger about the pivot 12 out of the path of travel of the recoil mass 58 which then proceeds in its movement past the opening 4. After the recoil mass has passed the opening 4, as shown in FIG. 6, of the reset spring 54 in FIGS. 1 and 2, is free to reset the toggle mechanism thereby pivoting the plunger latch housing 8 and plunger 6 in the direction of arrow 64 whereby the plunger 6 is repositioned in latch position as illustrated in FIG. 6. When the recoil mass begins its return motion as indicated by the arrow 66 in FIG. 7 the recoil mass engages the plunger 6 but because of the sloped surface 7 on the plunger head 5, the recoiling mass depresses the plunger into the housing 8 against the action of spring 24 and passes the opening 4 to return to its latch position as illustrated in FIG. 8. Note that the pressure forces acting on the toggle assembly are at a minimum when the plunger is depressed. Thus the recovery force of the reset spring need only be sufficient to return the toggle assembly to its operative position.

When the end of the recoil mass has passed the opening 4, spring 24 is free to return the plunger to its latch position shown in FIG. 8. The ring spring assembly 36 acts in absorbing the impact shock imparted to the latch assembly by the recoiling mass as it relatches after firing of the gun. The breech can now be opened and another round of ammunition loaded.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A recoilable gun tube latch for a gun tube mechanism mounted for reciprocal movement on a gun cradle on fire out of battery (soft recoil) artillery weapons, said latch comprising:

a first housing having an opening, latch means in said housing including a plunger having a head with a sloped surface positionable to extend through said opening in a first latching position for latching of said gun tube mechanism in its rearward position on said cradle, a pivotable plunger housing for said plunger located in said first housing, release means for actuating said plunger and plunger housing to permit movement of said plunger and plunger housing from said first plunger latching position, said release means including means for pivoting said plunger housing and said plunger from said first latching position to a second nonlatching position in said first housing, means for resetting said release means to return said plunger housing and plunger to said first latching position in said opening after said gun tube mechanism has passed said opening in movement in a counterrecoil direction, and means for biasing said plunger head from said second housing through said opening into said first latching position in the path of movement of said gun tube mechanism for engagement with and to latch said gun tube mechanism, said biasing means, when said plunger has returned to its latching position, being responsive to contact said gun tube mechanism with the head of said plunger during movement of said gun tube mechanism in a recoil direction to depress said plunger head into said plunger housing and thereby to permit said gun tube mechanism to pass the opening to complete movement in said recoil direction, said means for pivoting said plunger including an articulated toggle assembly of a plurality of movable links, a first link being pivotally connected to said second housing and a second link having a pivot connection to said first link and to said first housing, a third link movably connected to said first housing and to said pivot connection between said first and second links, said third link being movably responsive to release means to collapse said links to permit pivotal movement of said plunger and plunger housing from said latching position to said unlatching position, said resetting means including spring means acting on said second link adjacent the connection of the second link to said first housing to return and hold the toggle links in their uncollapsed position whereby the plunger and plunger housing are returned to said latching position, said plunger including a recess and said biasing means including a shaft bottomed on said second housing at one end and engaging the plunger at its other end and a spring circumscribing said shaft for biasing of said plunger head from said second housing.

2. The assembly of claim 1 wherein said spring means is a coil spring bearing at one end on the first housing and at its other end against said second link, said spring being coiled about a pivot pin forming a pivot point for said second link.

3. The assembly of claim 1 wherein said release means is a movable device connected to said third link for pivoting of said links and said plunger housing.

* * * * *